US009643777B2

(12) United States Patent
Warren

(10) Patent No.: US 9,643,777 B2
(45) Date of Patent: May 9, 2017

(54) INFLATABLE REFUSE CONTAINERS AND METHODS OF USE

(71) Applicant: William J. Warren, Frisco, TX (US)

(72) Inventor: William J. Warren, Frisco, TX (US)

( * ) Notice: Subject to any disclaimer, the term of this patent is extended or adjusted under 35 U.S.C. 154(b) by 0 days.

(21) Appl. No.: 15/006,071

(22) Filed: Jan. 25, 2016

(65) Prior Publication Data

US 2016/0137410 A1 May 19, 2016

Related U.S. Application Data

(63) Continuation of application No. 14/275,907, filed on May 13, 2014, now Pat. No. 9,248,963.

(60) Provisional application No. 61/855,361, filed on May 14, 2013.

(51) Int. Cl.

| | |
|---|---|
| ***B65F 1/00*** | (2006.01) |
| ***B65F 1/02*** | (2006.01) |
| ***B65F 1/08*** | (2006.01) |
| ***B65F 1/14*** | (2006.01) |

(52) U.S. Cl.

CPC ..... *B65F 1/0006* (2013.01); *B65F 1/02* (2013.01); *B65F 1/08* (2013.01); *B65F 1/14* (2013.01); *B65F 2210/13* (2013.01); *B65F 2210/132* (2013.01); *B65F 2220/116* (2013.01)

(58) Field of Classification Search

CPC .... B65F 1/08; B65F 1/068; B65F 1/06; B65F 1/04; B65F 1/02; B65F 1/0006; B65F 1/14; B65D 25/18; B65D 25/16; B65D 25/14; B65D 37/00

USPC ..... 220/495.08, 495.06, 9.1–9.4

See application file for complete search history.

(56) References Cited

U.S. PATENT DOCUMENTS

| | | | |
|---|---|---|---|
| 2,587,033 | A | 2/1952 | Dobbs et al. |
| 2,751,953 | A | 6/1956 | Grimm |
| 3,000,185 | A | 9/1961 | Brinkmann |
| 3,044,515 | A | 7/1962 | Eades |
| 3,186,543 | A | 6/1965 | Minick et al. |
| 3,204,866 | A | 9/1965 | Brighton et al. |
| 3,294,223 | A | 12/1966 | Goban |
| 3,556,186 | A | 1/1971 | Besthorne |
| 3,742,994 | A | 7/1973 | Pensak |
| 4,000,585 | A | 1/1977 | Denaro |
| 4,044,867 | A | 8/1977 | Fisher |

(Continued)

FOREIGN PATENT DOCUMENTS

| | | | |
|---|---|---|---|
| EP | 374360 | A1 | 6/1990 |
| GB | 2314004 | A | 12/1997 |
| WO | WO9501294 | A1 | 1/1995 |

OTHER PUBLICATIONS

Translation of EP 374360 (Achterberg et al.), Jun. 27, 1990, pp. 3 and 8.

(Continued)

*Primary Examiner* — Robert J Hicks
(74) *Attorney, Agent, or Firm* — Carr & Ferrell LLP

(57) ABSTRACT

Provided are exemplary embodiments of a trash container. The trash container for collecting trash or waste may include an outer container having a first cavity and an inner container being connected to the outer container and being positioned within the first cavity. The outer container may include a bottom first wall, opposing first walls, and a back first wall to define the first cavity. The inner container may include a bottom inner wall, opposing inner sidewalls, and a back inner wall to define a second cavity. A space between the walls of the outer container and the inner container would be created.

20 Claims, 17 Drawing Sheets

(56) References Cited

U.S. PATENT DOCUMENTS

| | | | |
|---|---|---|---|
| 4,091,852 | A | 5/1978 | Jordan et al. |
| 4,103,810 | A | 8/1978 | Hickey |
| 4,375,809 | A | 3/1983 | Meals |
| 4,384,603 | A | 5/1983 | Tyrer et al. |
| 4,612,781 | A | 9/1986 | Swerdon |
| 4,809,352 | A | 2/1989 | Walker |
| 4,858,755 | A | 8/1989 | Kuivanen |
| 4,867,576 | A | 9/1989 | Boyd |
| 4,919,290 | A | 4/1990 | Wadel |
| 4,941,754 | A | 7/1990 | Murdock |
| 5,127,523 | A | 7/1992 | Herdlicka |
| 5,209,364 | A | 5/1993 | LaPoint, Jr. |
| 5,314,250 | A | 5/1994 | Lee |
| 5,692,833 | A | 12/1997 | DeLuca |
| 5,735,495 | A | 4/1998 | Kubota |
| 6,123,217 | A | 9/2000 | Miller |
| 6,606,880 | B1 | 8/2003 | Carlin et al. |
| 7,972,063 | B1 | 7/2011 | Barsalou |
| 9,199,790 | B2 | 12/2015 | Warren |
| 9,248,962 | B2 | 2/2016 | Warren |
| 9,248,963 | B2 | 2/2016 | Warren |
| 2005/0066562 | A1 | 3/2005 | Bober et al. |
| 2006/0207849 | A1 | 9/2006 | Sadow |
| 2010/0303387 | A1 | 12/2010 | Dahlquist |
| 2015/0021333 | A1 | 1/2015 | Warren |
| 2015/0023613 | A1 | 1/2015 | Warren |
| 2015/0076145 | A1 | 3/2015 | Warren |
| 2016/0023845 | A1 | 1/2016 | Warren |
| 2016/0137409 | A1 | 5/2016 | Warren |

OTHER PUBLICATIONS

Office Action, mailed Aug. 22, 2016, U.S. Appl. No. 14/876,758, filed Oct. 6, 2015.

Final Office Action, mailed Nov. 7, 2016, U.S. Appl. No. 15/006,063, filed Jan. 25, 2016.

Notice of Allowance, mailed Dec. 5, 2016, U.S. Appl. No. 14/876,758, filed Oct. 6, 2015.

INFLATABLE REFUSE CONTAINERS AND METHODS OF USE

CROSS-REFERENCE TO RELATED APPLICATION

The present application is a Continuation of U.S. patent application Ser. No. 14/275,907 (now U.S. Pat. No. 9,248,963, issued Feb. 2, 2016), filed May 13, 2014, which claims the benefit of U.S. Provisional Patent Application No. 61/855,361, filed on May 14, 2013. The subject matter of the aforementioned applications is incorporated herein by reference for all purposes.

FIELD

The present invention relates to trash containers and, more particularly, to a trash container having flexible walls.

BACKGROUND

Trash is a common problem around the home, office and outdoors. In order to collect this trash, trash cans have been used. However, these trash cans can be small and generally have rigid sidewalls. The rigid sidewalls prevent the trash cans from being flattened out and stored in a relatively small space. What is needed is a trash can which can be easily deployed and easily stored in a limited space.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

A trash container for collecting trash (or a container for collecting pet waste) may include an outer container having a first cavity and an inner container being detachably connected to the outer container and being positioned within the first cavity. The outer container may include a bottom first wall, opposing first side walls and a back first wall to define the first cavity. The inner container may include a bottom inner wall, the opposing inner sidewalls and a back inner wall to define a second cavity.

In some embodiments, the outer container may not have a front wall.

In other embodiments, the inner container may not have a front wall.

According to some embodiments, the outer container may be inflatable by an inflation tube.

In some embodiments, the inner container may be inflatable.

In other embodiments, the inner container may include an inclined wall which extends from the back wall to the bottom wall.

According to some embodiments, the present technology is directed to a trash container, comprising: (a) an outer container forming a first cavity, wherein the outer container is inflatable by an inflation tube; (b) an inner container forming a second cavity, the inner container being disposed within the first cavity in such a way that a sealed space between the inner container and the outer container is created, wherein the sealed space is filled with a fluid; and (c) an interface for introducing or removing the fluid into the sealed space.

BRIEF DESCRIPTION OF THE DRAWINGS

Embodiments are illustrated by way of example and not limitation in the figures of the accompanying drawings, in which like references indicate similar elements.

DETAILED DESCRIPTION

The technology disclosure herein relates to exemplary embodiments of trash containers.

Figure 1:
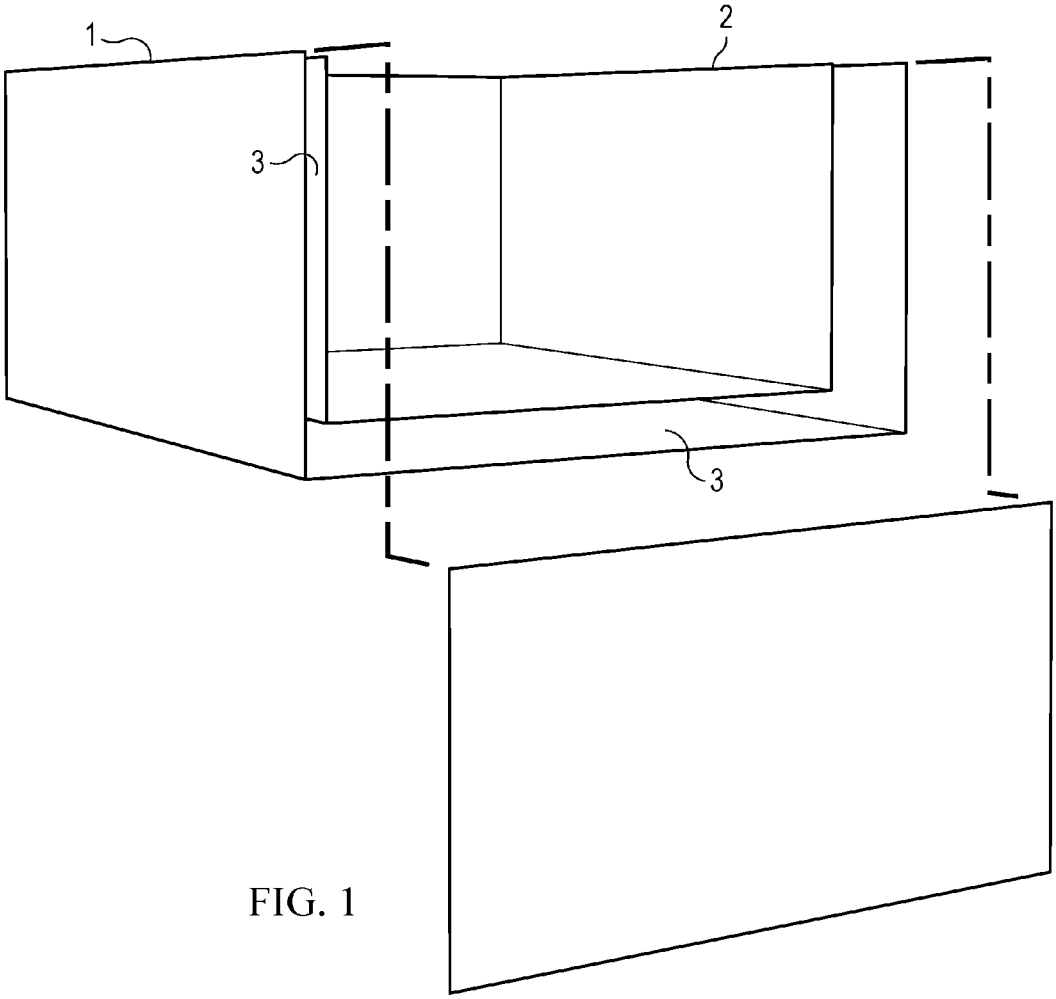
FIG. 1 illustrates a perspective view of the trash container, according to exemplary embodiments.

FIG. 1 is a cross section view of the front of the device (trash container), with the front skin (portion of the outer shell) missing, according to exemplary embodiments. An outer shell (container) 1 is illustrated as well as an inner shell (container) 2. The inner shell 2 and the outer shell 1 can be made out of a HEFTY or GLAD bag, (or other such disposable plastic refuse bags), a biodegradable material, or any other type of material deemed to be effective. A space 3 illustrates where the air or liquid or space is received between the outer shell 1 and the inner shell 2.

Figure 2:
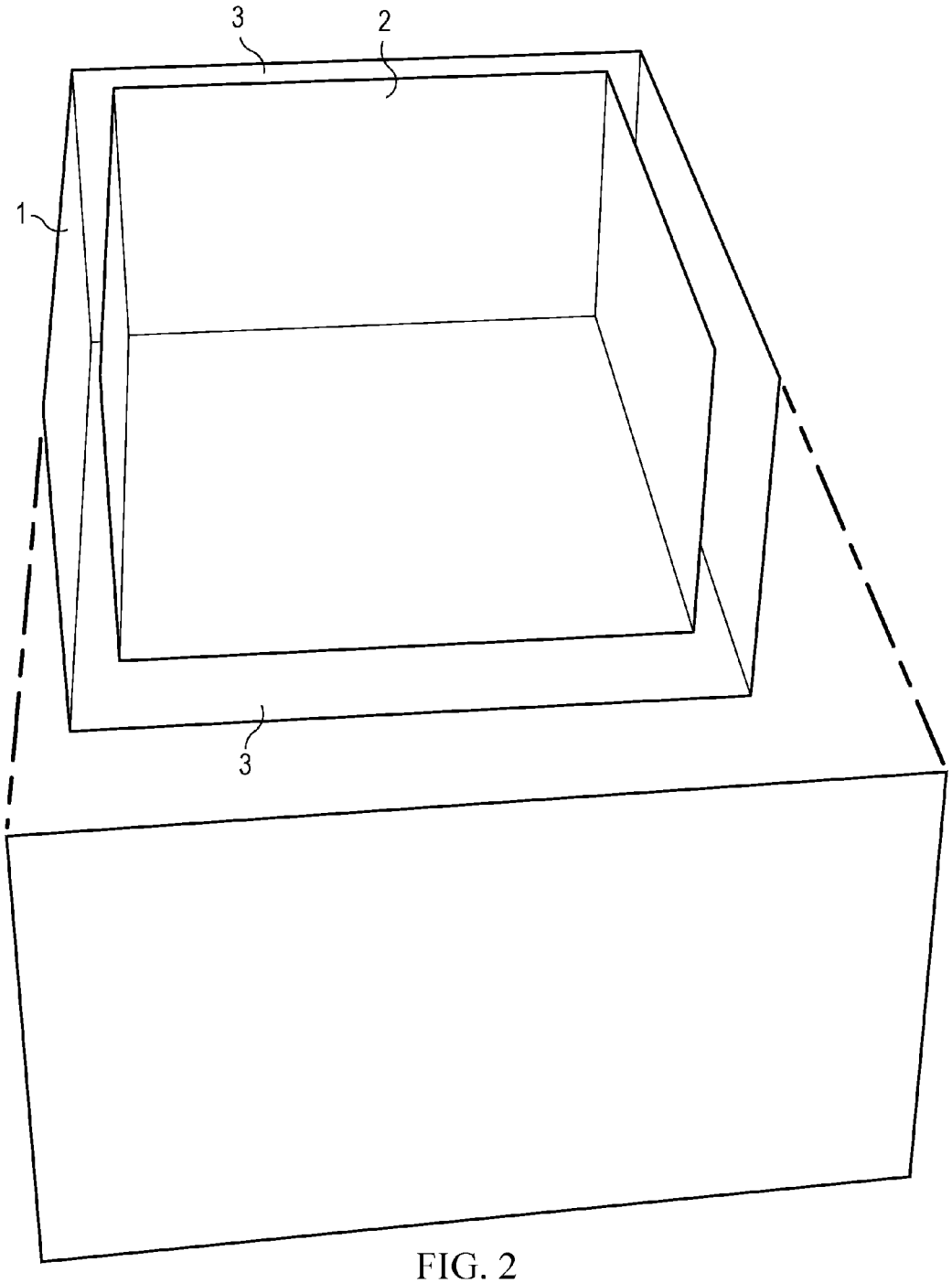
FIG. 2 illustrates a top perspective view of the trash container, according to exemplary embodiments.

FIG. 2 illustrates the space or area 3 from a different perspective. The space 3 is a result of the outer shell 1 and the inner shell 2 being separated.

Figure 3:
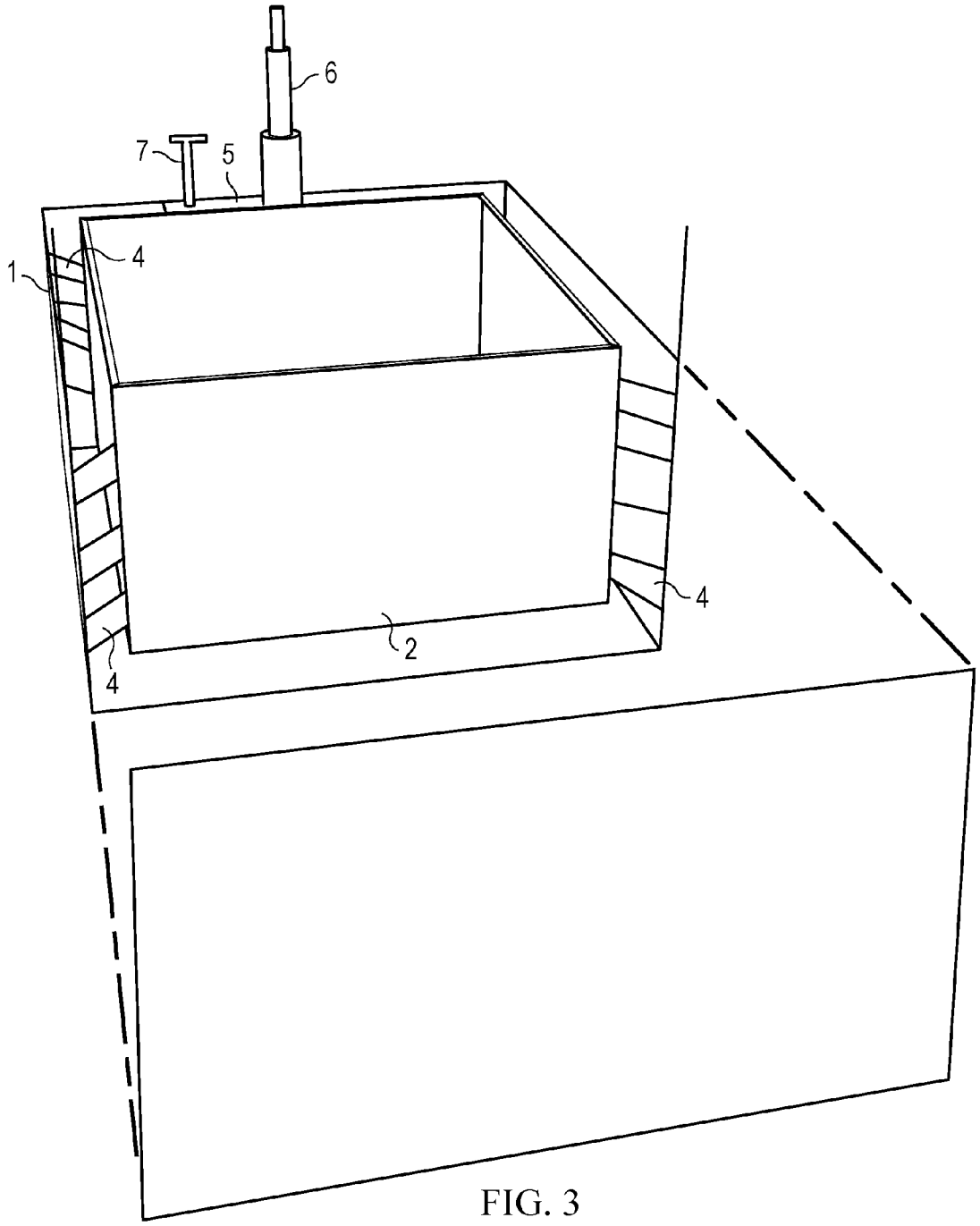
FIG. 3 illustrates a perspective view of the trash container, according to exemplary embodiments.

FIG. 3 illustrates a structural support 4, where the structural support 4 holds the outer shell 1 and the inner shell 2 together in a structurally sound manner (as well as air tight) so as to create space 3 for air, water, etc. Structural support 4 is preferably made out of the same material as outer shell 1 and inner shell 2. This combination will create a chamber between the outer shell 1 and the inner shell 2 to trap air or liquid in the space or area 3 and sealed off by a top support 5. Support 5 is shown only partially. A blow tube 6 is provided to inflate the space 3 in between the outer shell 1 and the inner shell 2, which is supported by support 5. The blow tube 6 can be inflated by human, a carbon dioxide canister or device, or an electric or manual pump air device. A cleat 7 is provided to tie cords or stings to attach a dog leash.

Figure 4:
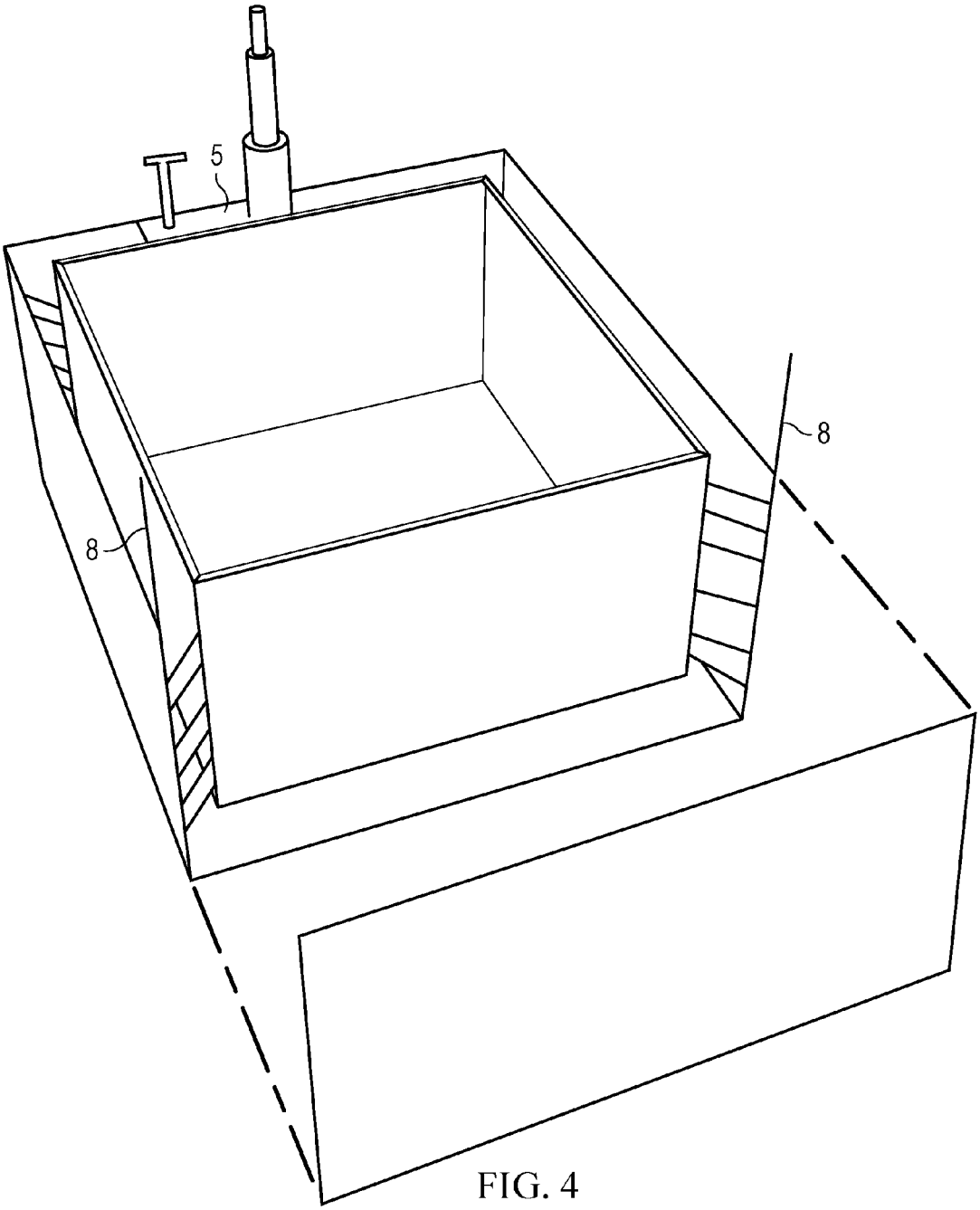
FIG. 4 illustrates a perspective view of the trash container, according to exemplary embodiments.

FIG. 4 illustrates a tie cord 8 which is made of the same material as outer shell 1, inner shell 2, and support 5, for rapid discarding of waste disposed within the trash container.

Figure 5:
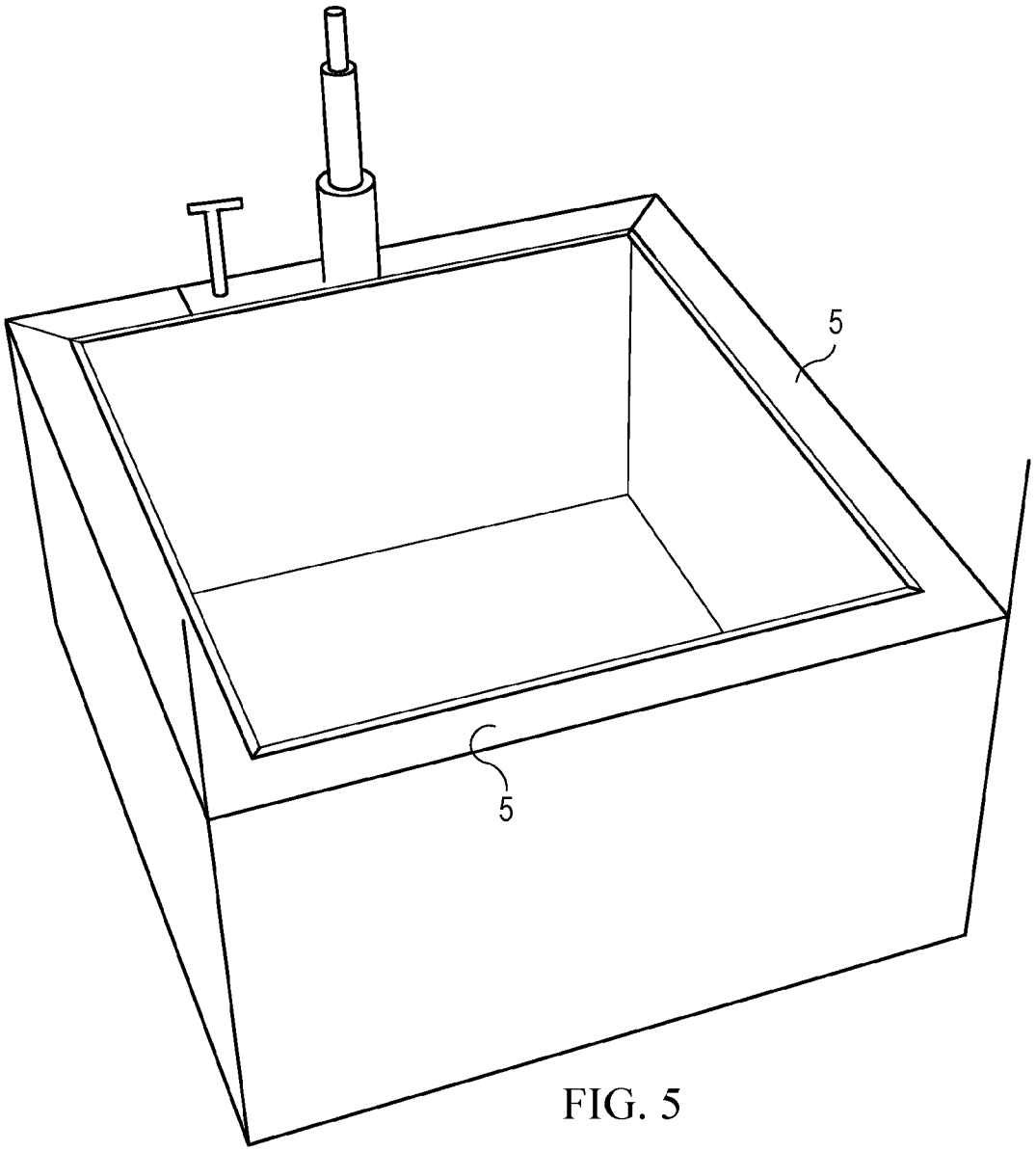
FIG. 5 illustrates a top perspective view of the trash container, according to exemplary embodiments.

FIG. 5 illustrates where the support 5 will go around on top of the device.

Figure 6:
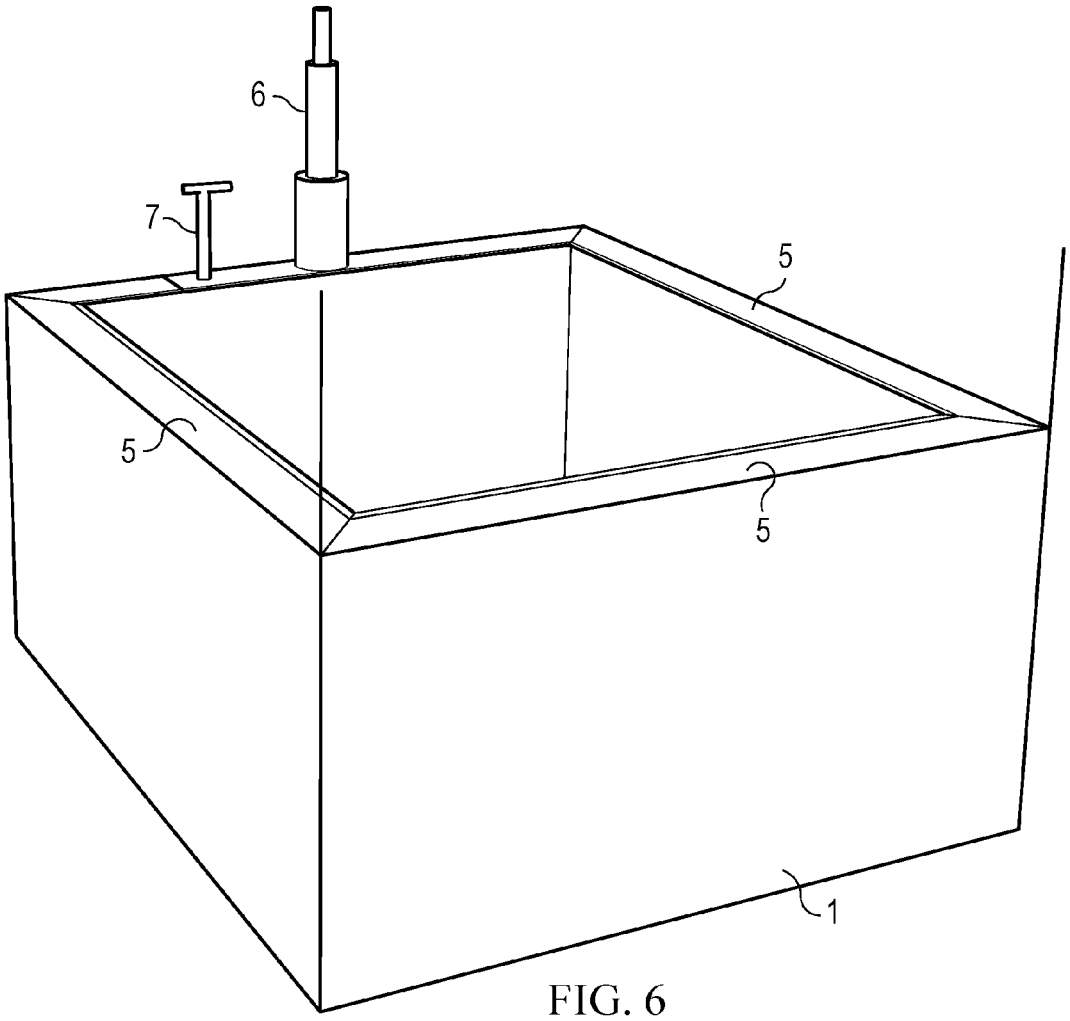
FIG. 6 illustrates a side perspective view of the trash container, according to exemplary embodiments.

FIG. 6 shows the outer shell 1 in place as well as the configuration of the trash container if the support 5 and the blow tube 6 are placed in combination.

Figure 7:
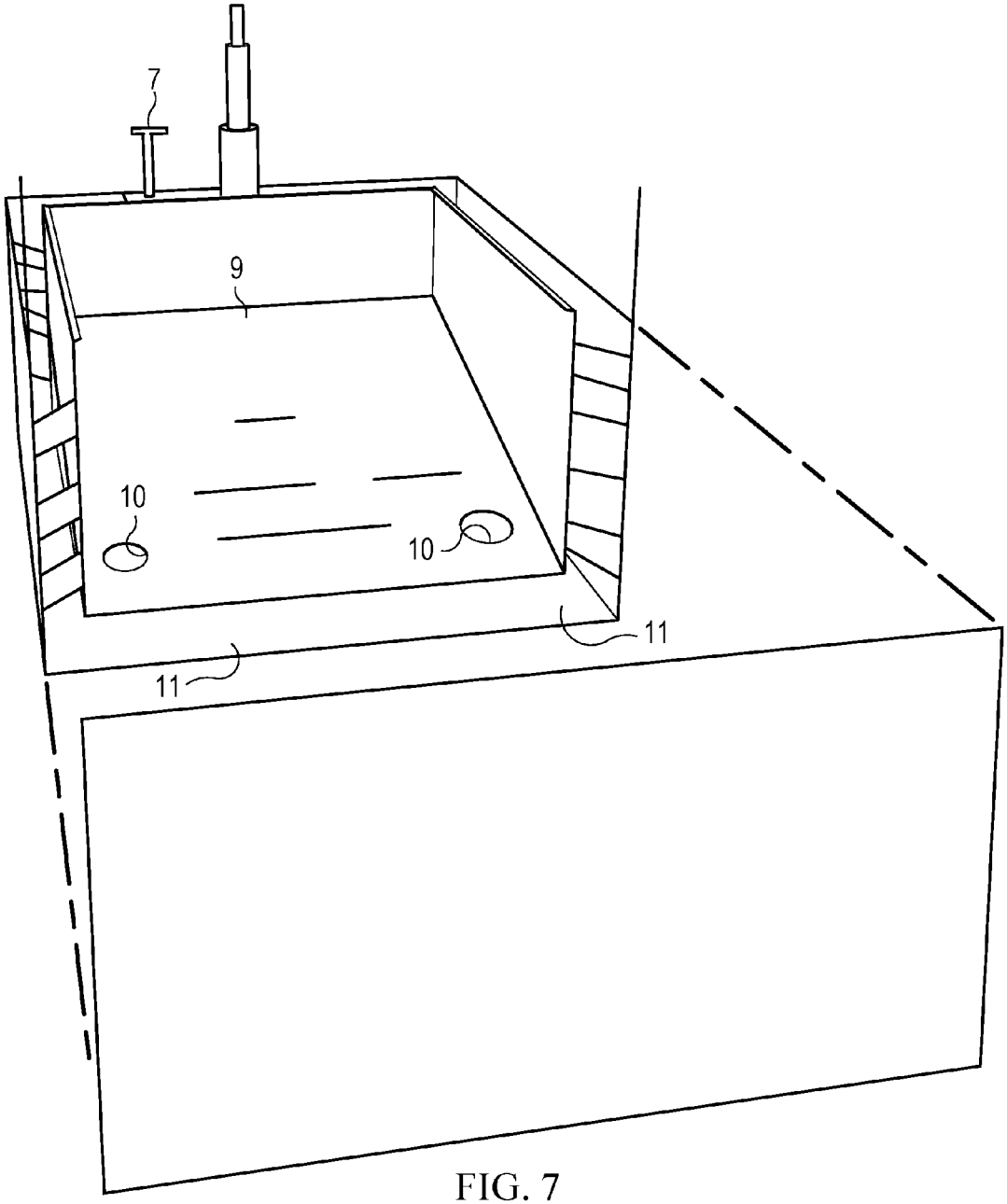
FIG. 7 illustrates a front perspective view of the trash container, according to exemplary embodiments.

FIG. 7 illustrates a floor 9 that is at an incline, which allows solids or liquids to gravitate towards holes or slats 10 created to get trapped in a space or cavity 11. The cavity 11 could receive and retain a liquid or solid absorbing material.

Figure 8:
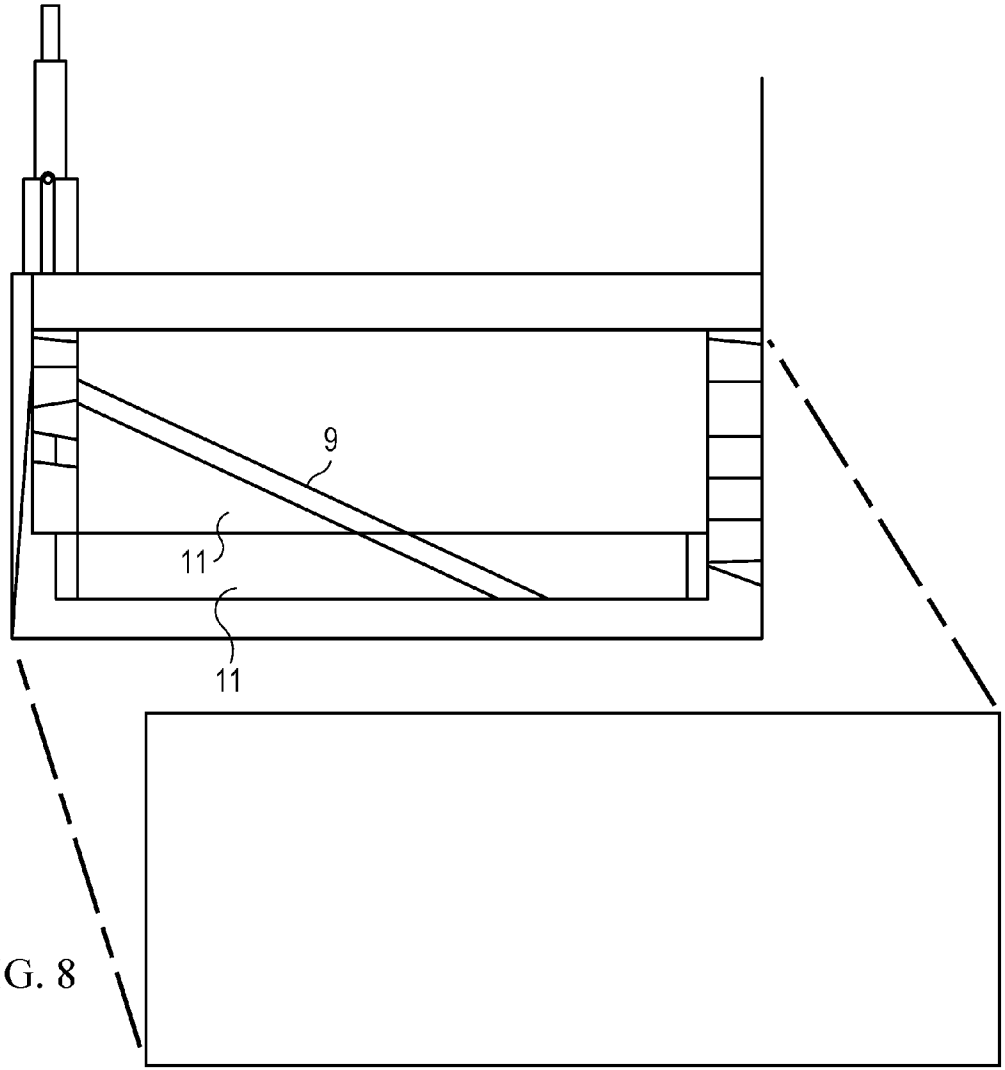
FIG. 8 illustrates a cross-sectional view of the trash container, according to exemplary embodiments.

FIG. 8 illustrates the space or cavity 11 where solids and liquids get trapped. The space or cavity 11 can be provided with a urine absorbing or solid type of absorption material.

Figure 9:
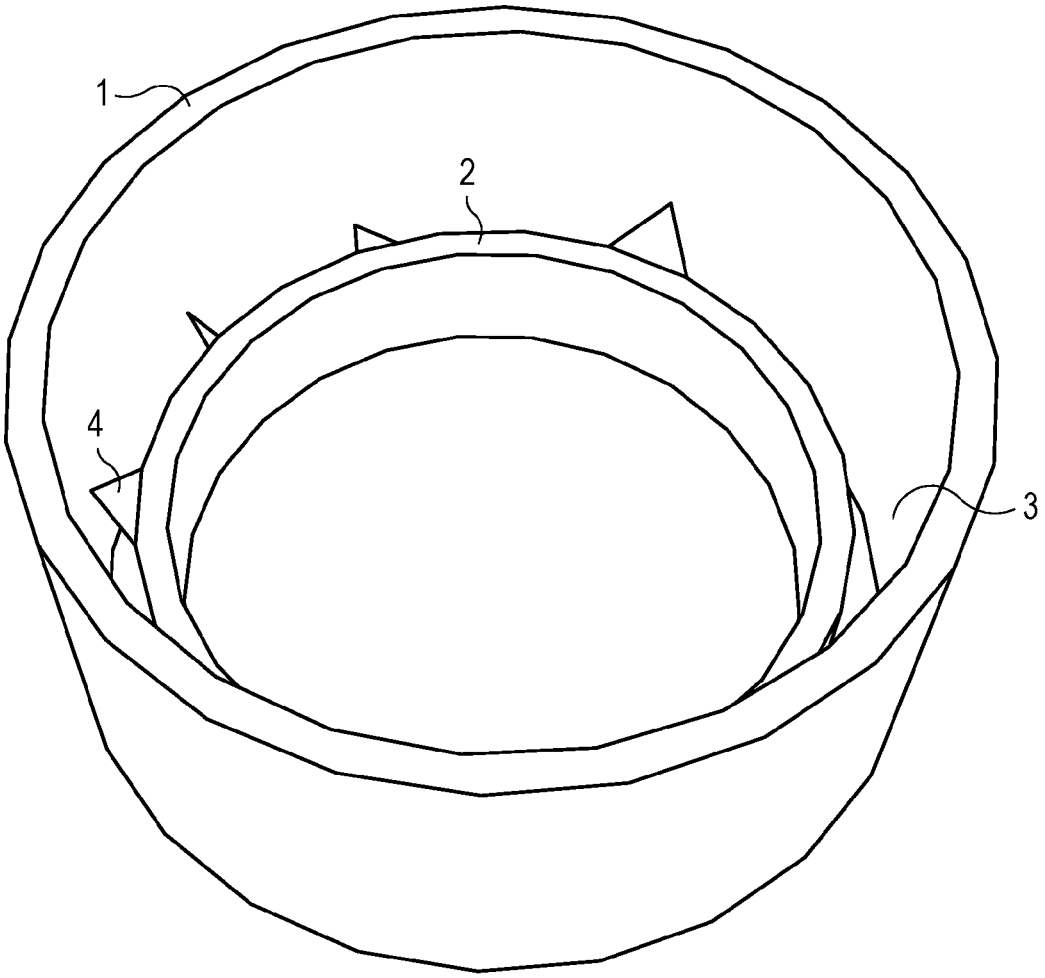
FIG. 9 illustrates a top perspective view of the trash container, according to exemplary embodiments.

FIG. 9 illustrates an outer shell 1 and an inner shell 2, of another example embodiment of a trash container. A material 4 can be utilized to adhere the outer shell 1 and the inner shell 2 together to form a space 3.

Figure 9A:
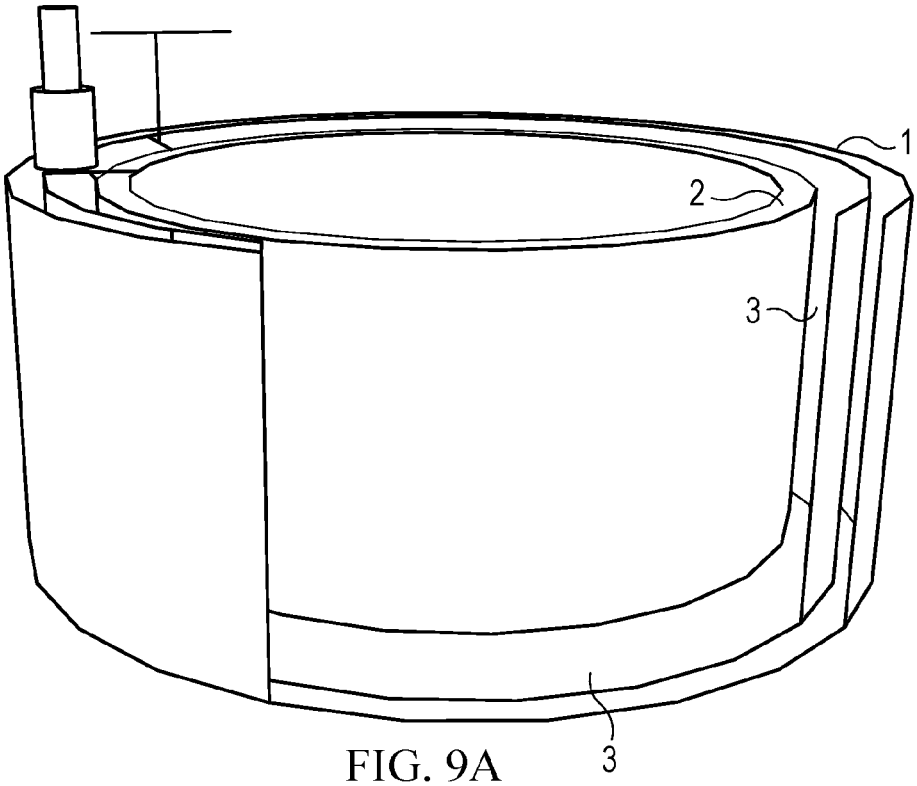
FIG. 9A illustrates a cross-sectional view of the trash container, according to exemplary embodiments.

FIG. 9A shows a cross section with a cutout of the outer shell 1 and the inner shell 2 with the space 3 for air or liquid.

Figure 10:
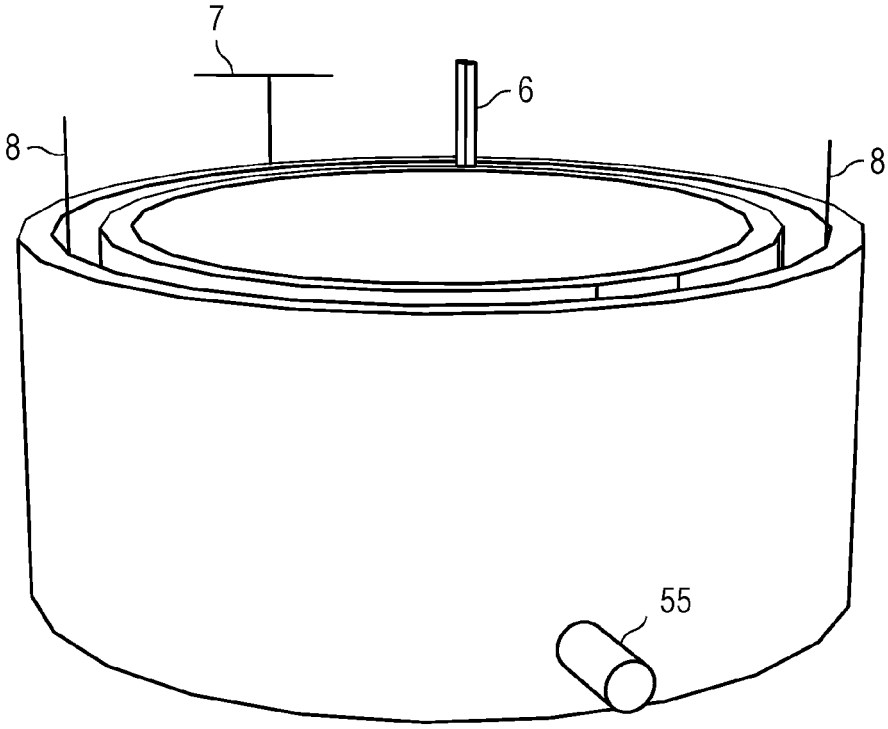
FIG. 10 illustrates a perspective view of the trash container, according to exemplary embodiments.

FIG. 10 illustrates a blow tube 6, shows a cleat 7, as well as the space 3 and a tie cord 8. An air release valve 55 is also shown.

Figure 11:
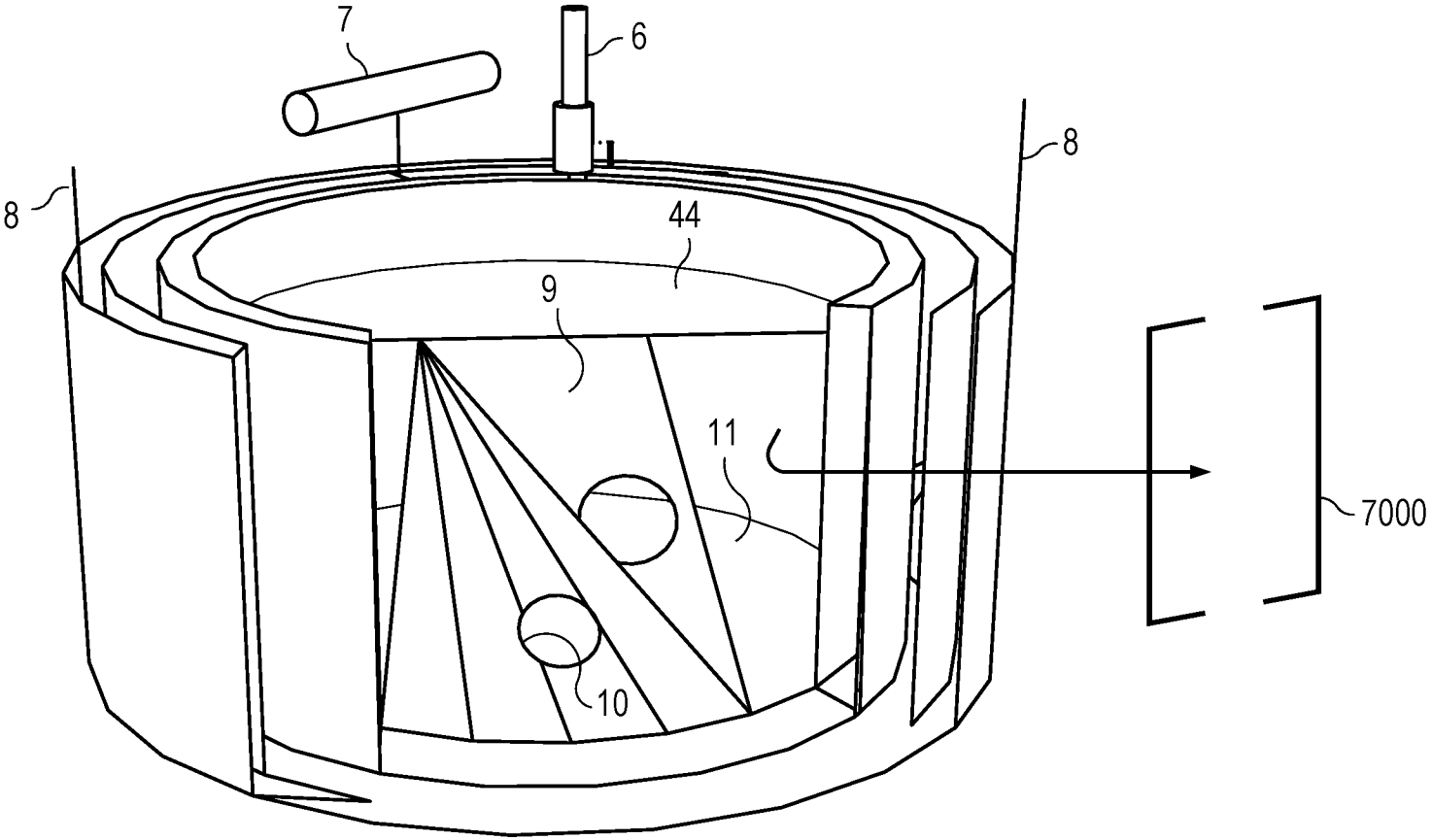
FIG. 11 illustrates a cross-sectional view of the trash container, according to exemplary embodiments.

FIG. 11 illustrates an area 44 that is flat so a pet or any other animal or object can rest thereon. A tie cord 8 is provided for rapid discarding of waste disposed within the trash container. A floor 9 is disposed at an incline. Holes or slats 10 are provided so that solids or liquids can have access to a cavity 11.

Figure 12:
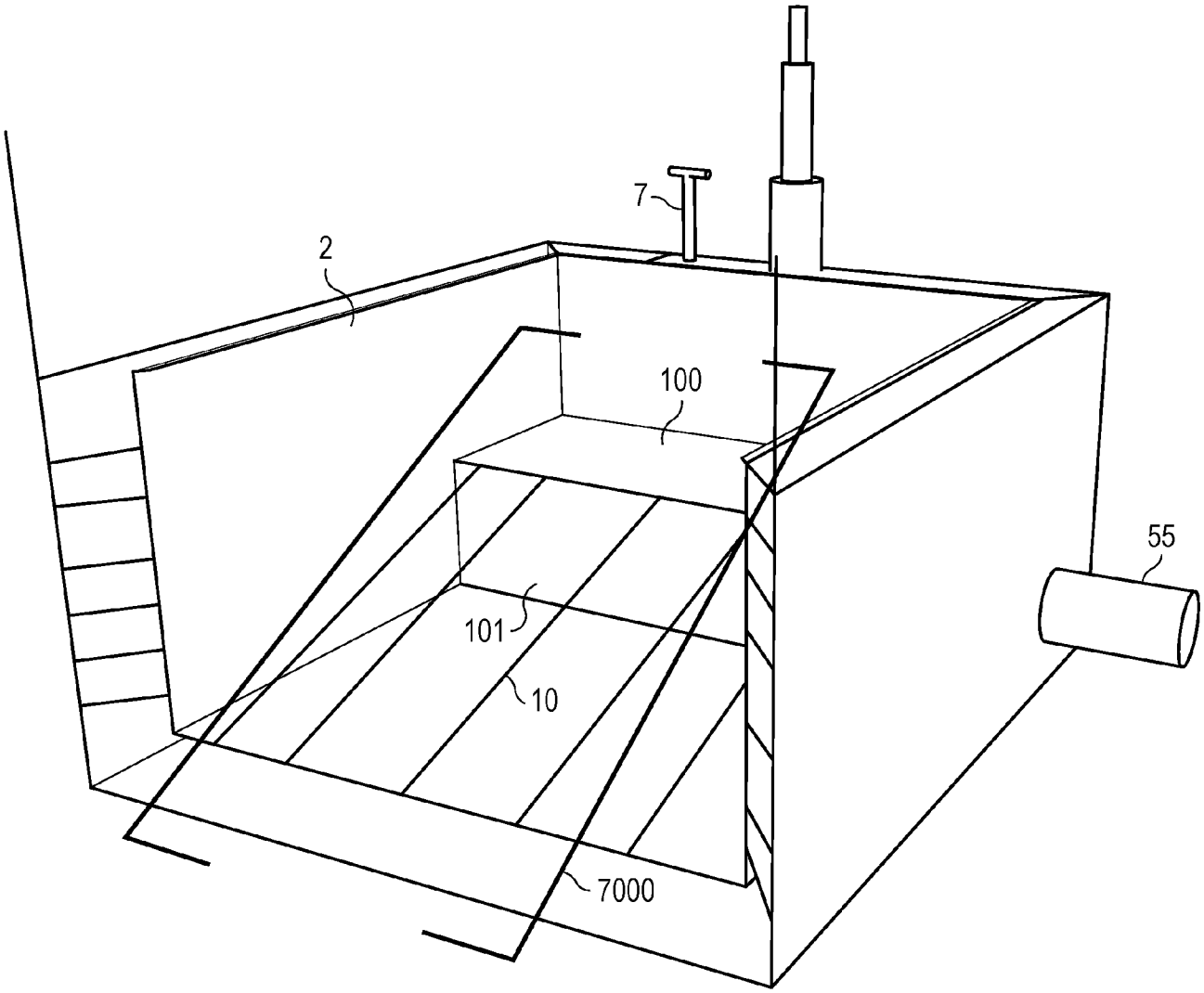
FIG. 12 illustrates a cross-sectional view of the trash container, according to exemplary embodiments.

FIG. 12 is a view of an inflatable support type bench 100 to support an animal, human, etc. (also indicated by bracket 7000). A wall 101 is provided to create a chamber within the inflatable support bench 100 to hold air or liquid to form the bench. An object can be tied to the cleat 7, such that solids and liquids will run by gravity to slats and holes 10. Therefore, a continuous air space 3 is provided for easy blow up and deflation for disposal. The air release valve 55 is provided for air to escape during deflation. The air release valve 55 can be incorporated into any embodiment.

Figure 13:
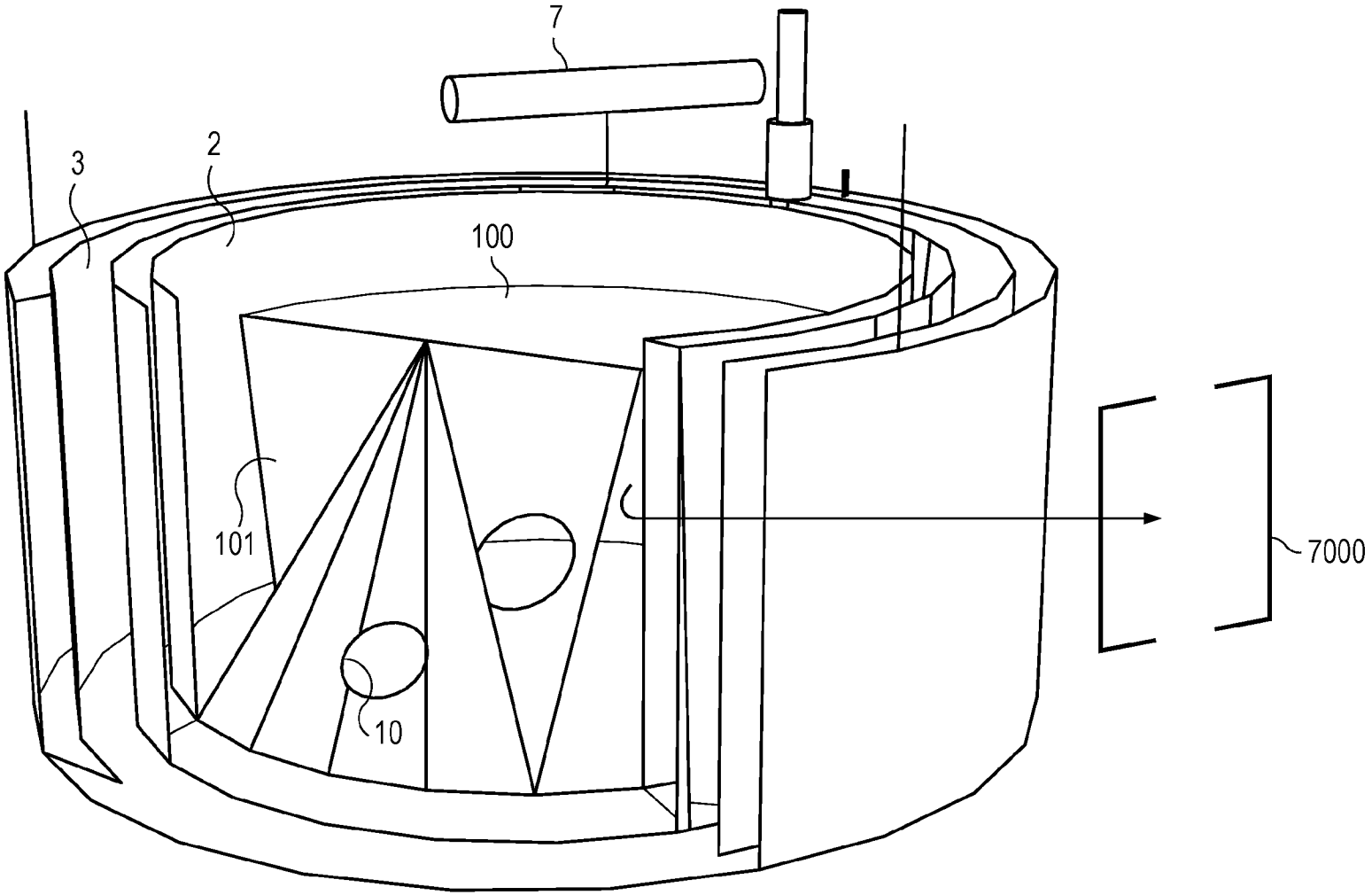
FIG. 13 illustrates a cross-sectional view of the trash container, according to exemplary embodiments.

FIG. 13 is a view of an inflatable support bench 100 for pets, individuals, and so forth, (also indicated by bracket 7000). A cleat tie 7 is also provided as a tie down mechanism. The space 3 underneath the bench will be supported by inflation of the inflatable support bench 100. A wall 101 is provided to create a chamber within the inflatable support 100 to hold air or liquid to form the bench.

Figure 14:
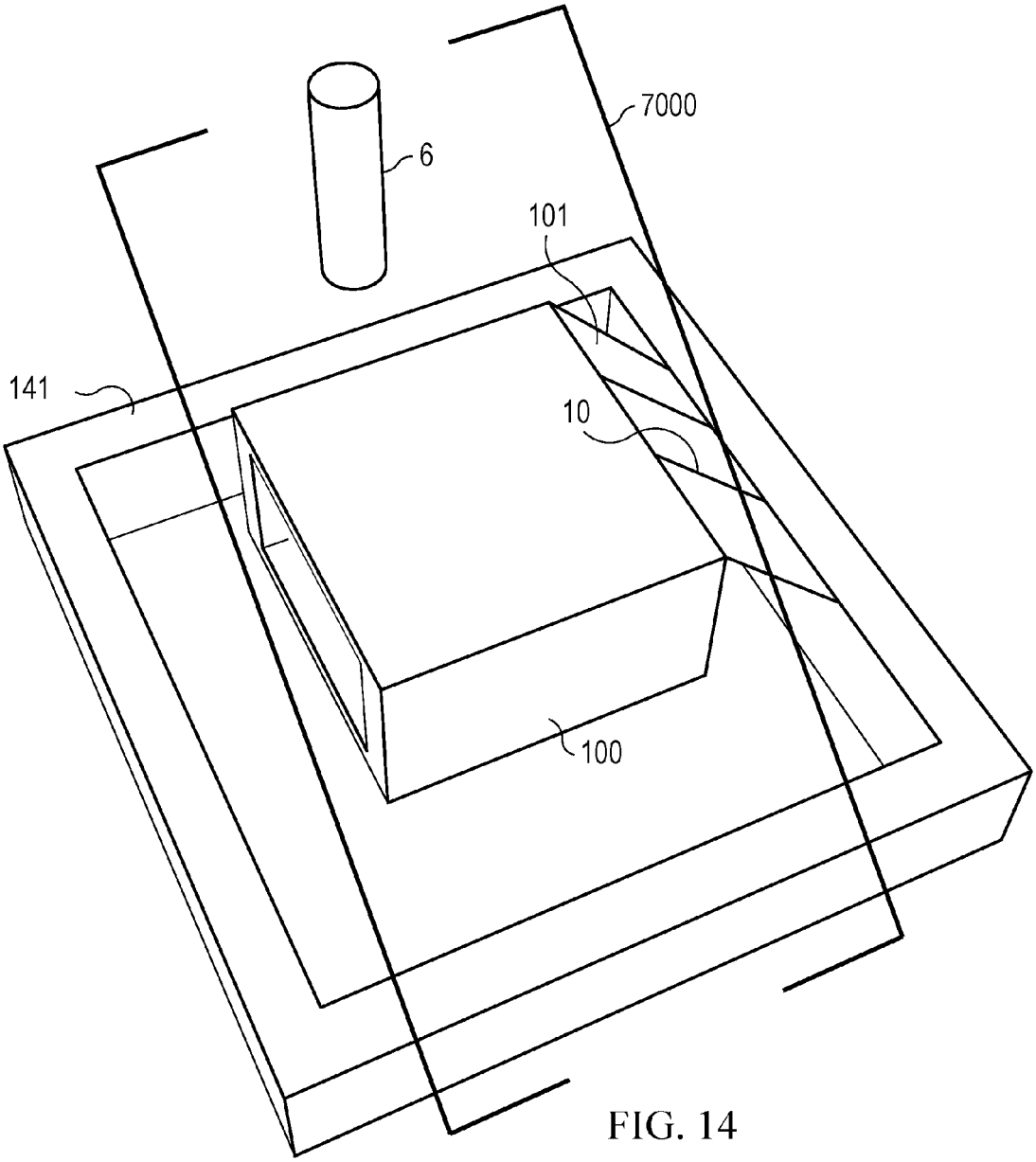
FIG. 14 illustrates a top perspective view of the trash container, according to exemplary embodiments.

FIG. 14 illustrates the cross section of the bench 100. The bench was shown in FIG. 12. By isolating the bench 100, a separate blow tube 6 can be used to inflate the bench 100. The bench 100 could also be inflated when the frame 141 is inflated. 007 is a bottom floor. The frame 141 is not shown to full height. The frame 141 would be the normal height of trash container. The blow tube 6 is shown to illustrate that the bench 100 can be inflated as a stand alone or with the frame 141.

Figure 15:
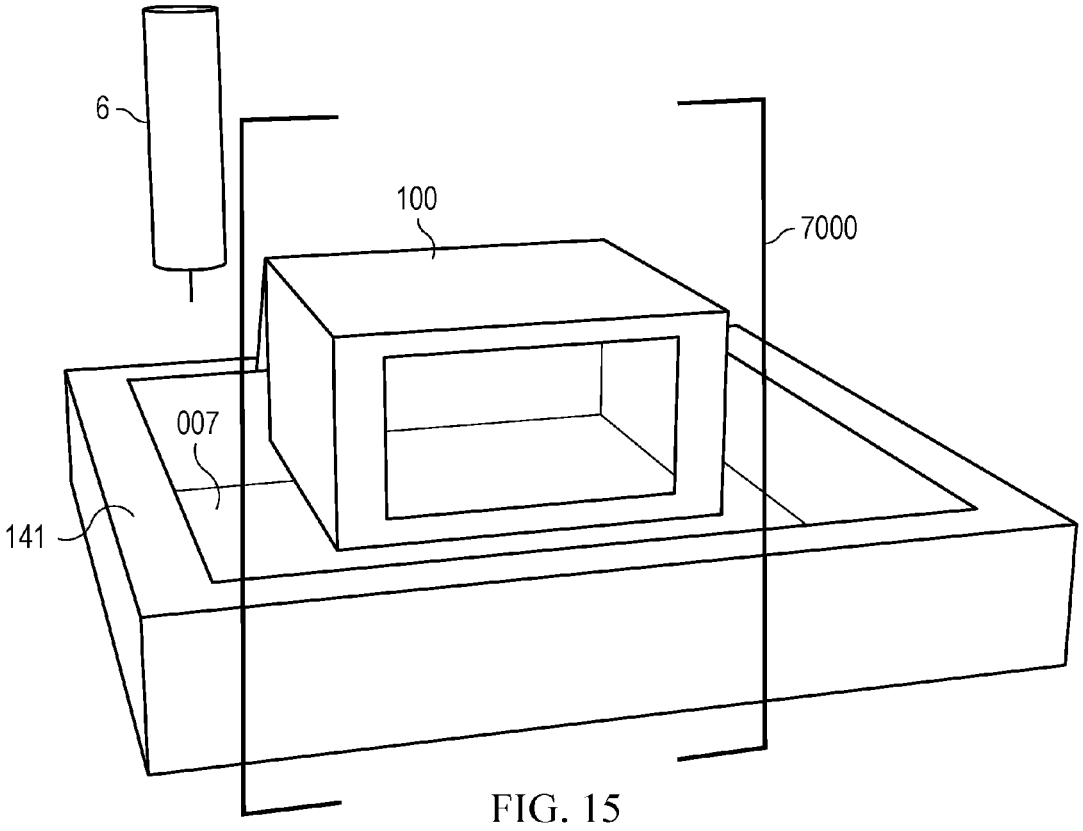
FIG. 15 illustrates an exploded view of the trash container, according to exemplary embodiments.

FIG. 15 is a different angle of FIG. 14. FIG. 15 shows another angle of support for bench inflation system.

Figure 16:
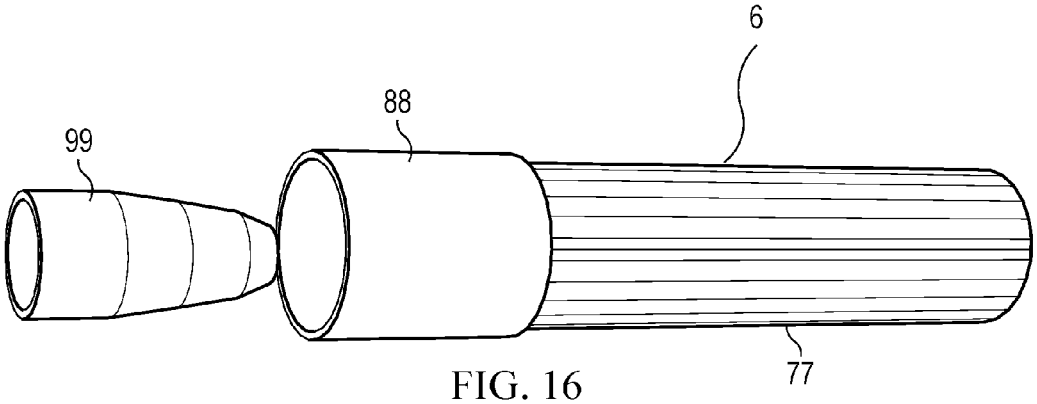
FIG. 16 illustrates a cross-sectional view of the trash container, according to exemplary embodiments.

FIG. 16 demonstrates the blow tube 6 with a tube 77 that attaches to the structure for easy blow up, and may or may not be rigid. If not rigid, it can be tied easily to cut off escaping air or, after being tied, it can be cut to release the air. A rigid piece 88 allows for air machines, CO2, or any other devices to inflate the structure. A cap 99 is provided in some embodiments.

Figure 17:
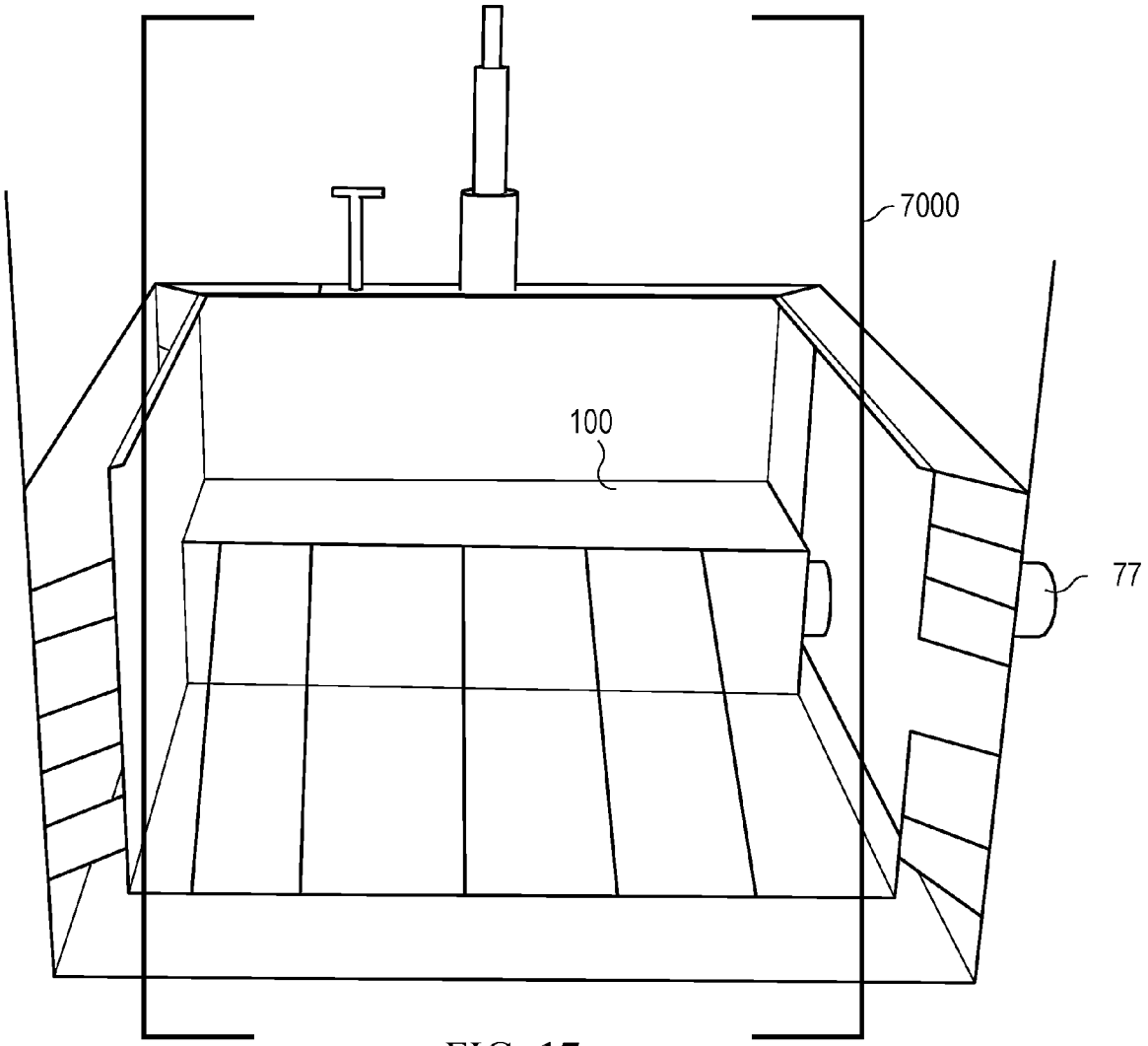
FIG. 17 illustrates a front perspective view of the trash container, according to exemplary embodiments.

FIG. 17 illustrates the view of the pet bench 100, which is provided in some embodiments. The tube 77 may act as a quick air or liquid release to release air or liquid from the bench 100 by cutting of the tube 77.

Figure 18:
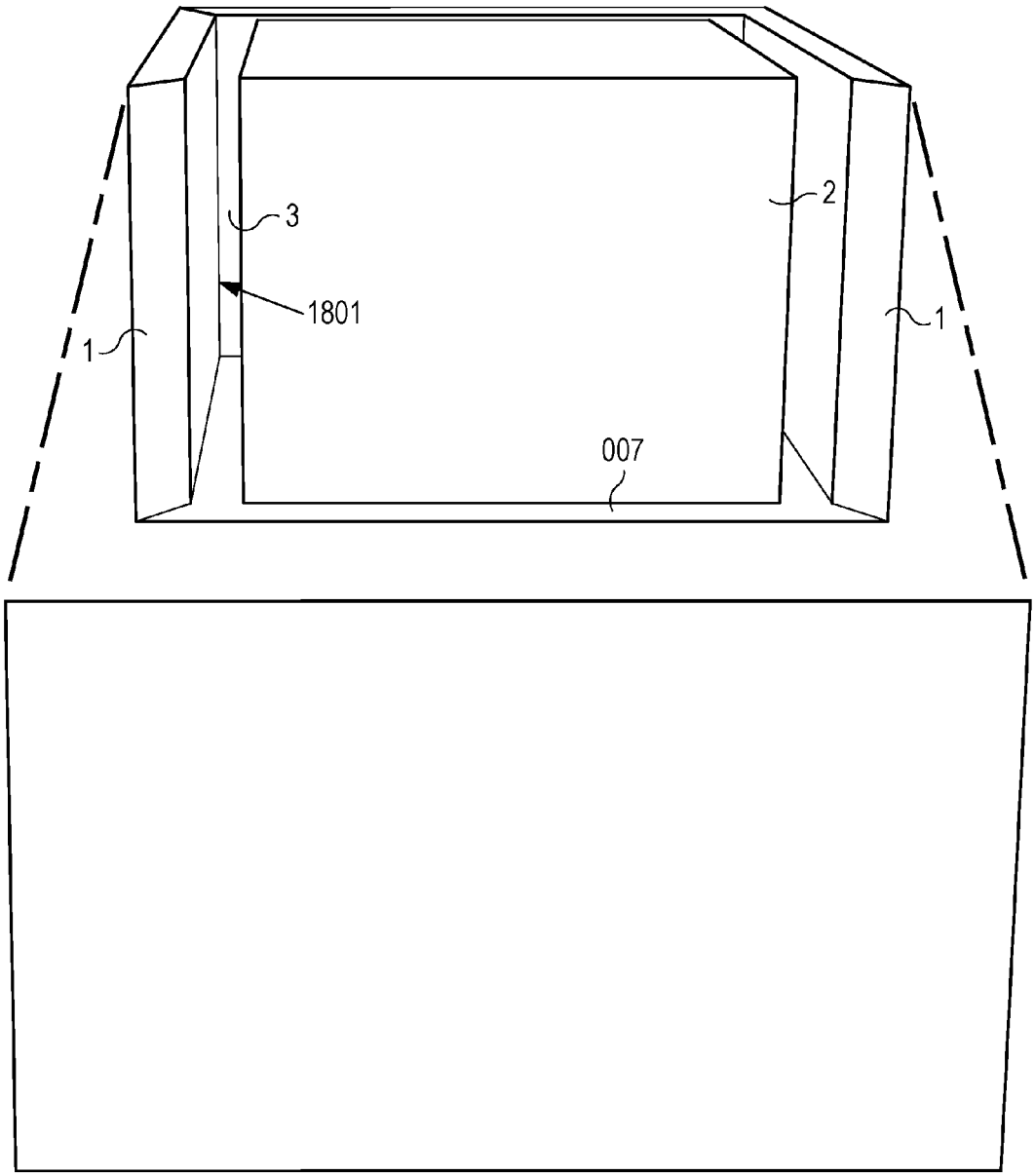
FIG. 18 illustrates a front perspective view of the trash container of the present invention.

FIG. 18 illustrates outer shell 1 and inner shell 2 with no air or liquid space in between outer shell 1 and inner shell 2 to form a bottom 007. According to various embodiments, the two shells 1 and 2 are essentially joined as one unit to form a bottom support 007 for systems. Air or liquids will be filled within the periphery 1801 to support the system. In certain other embodiments, the inflation systems include ground support systems.

An example bracket 7000 is illustrated in FIG. 14 that shows the "bench support". An exemplary function is to illustrate the isolation of the support or bench support to fit under any secondary floor that is not the lowest floor. The support is there to hold an animal on top so solids and fluids run down the secondary floor. As illustrated in other drawings, there may be holes in secondary floor. This is shown in FIG. 7, the inclined floor 9 and the holes, apertures, or slits. The bench location is also shown in FIG. 17. The bench is 100.

FIG. 15 is another angle of FIG. 14. Bottom 007, which may be inclined, has a view from underneath with holes in the material to let out waste to flow to bottom floor. The isolation of the bench 100 is one advantage of the present technology illustrated in FIG. 15.

The exemplary embodiments of the trash containers described above may include quick deflating tubes. These deflating tubes could be located at any suitable location on the trash containers.

According to some embodiments, such as the embodiment of FIG. 1, an example trash container can comprise an outer container forming a first cavity by outer shell 1. In some embodiments, the outer container is inflatable by an inflation tube. An inner container forms a second cavity by use of inner shell 2. The inner container is disposed within the first cavity in such a way that a sealed space (space 3) between the inner container and the outer container is created. The sealed space 3 is filled with a fluid or gas such as air. In some embodiments, the trash container comprises an interface for introducing or removing the fluid into the sealed space 3. An air release valve mounted on a sidewall of the outer container, such as valve 55 of FIG. 10, and valve 55 of FIG. 12, just as a few examples.

In some embodiments, the interface is disposed on a top of the trash container that seals the sealed space by extending between the outer container and the inner container. In some embodiments, a cleat tie is disposed on the top of the trash container and adjacent to the interface.

As mentioned above, in some embodiments, a floor 9 of the inner container 2 is sloped towards holes 10 extending through the inner container 2. The holes 10 provide a path for communication of fluids out of the trash container or into a lower holding chamber or cavity 11 of the trash container.

In some embodiments, an absorbent material can be disposed in a space underneath the holes 10 such as the space or cavity 11.

According to some embodiments, sections of material are disposed within the sealed space to join the inner container 2 with the outer container 1.

An inflatable bench, such as bench 100 of FIG. 12 (or the bench illustrated in FIG. 17) can be formed from an inflatable support wall forming an inflatable support. In some embodiments, a blow tube can be included on the trash container for inflating the inflatable support wall.

In some embodiments, such as FIGS. 9-11, the inner container and the outer container are both cylindrical and the sealed space is an annular ring.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

What is claimed is:

1. An inflatable container, comprising:

an outer container forming a first cavity;

an inner container forming a second cavity, the inner container being disposed within the outer container in such a way that a space between the inner and outer containers is created and the inner container having a bottom floor that is sloped;

a top wall joining the inner and outer containers; and an inflation mechanism for introducing or removing a fluid or a gas into the space.

2. The inflatable container according to claim 1, wherein the inner container is detachably disposed within the outer container.

3. The inflatable container according to claim 1, wherein the inflation mechanism is disposed on the top wall.

4. The inflatable container according to claim 1, further comprising a cleat tie disposed on the top wall.

5. The inflatable container according to claim 1, further comprising a tie cord for rapid discarding of waste disposed within the inflatable container.

6. The inflatable container according to claim 1, further comprising an air release valve disposed on the outer container.

7. The inflatable container according to claim 1, wherein the bottom floor is sloped towards holes or slats extending through the inner container, the holes or slats providing a path for communication of fluids.

8. The inflatable container according to claim 7, further comprising an absorbent material disposed underneath the holes or slats.

9. The inflatable container according to claim 1, further comprising an inflatable support bench within the second cavity.

10. The inflatable container according to claim 9, wherein the inflatable support bench is in fluid communication with the space between the inner and outer containers.

11. The inflatable container according to claim 1, further comprising sections of structural support material disposed within the space to join and support the inner and outer containers.

12. An inflatable container, comprising:

an outer container forming a first cavity;

an inner container forming a second cavity, the inner container being detachably disposed within the outer container in such a way that a space between the inner and outer containers is created, the space comprising a support structure disposed within the space;

a top wall joining the inner and outer containers; and an inflation mechanism for introducing or removing a fluid or a gas into the space.

13. The inflatable container according to claim 12, wherein the inflation mechanism is disposed on the top wall.

14. The inflatable container according to claim 12, further comprising a cleat tie disposed on the top wall.

15. The inflatable container according to claim 12, further comprising a tie cord for rapid discarding of waste disposed within the inflatable container.

16. The inflatable container according to claim 12, further comprising an air release valve disposed on the outer container.

17. The inflatable container according to claim 12, further comprising an inflatable support bench within the second cavity.

18. The inflatable container according to claim 17, wherein the inflatable support bench is in fluid communication with the space between the inner and outer containers.

19. The inflatable container according to claim 12, wherein the support structure comprises sections of structural support material to join and support the inner and outer containers.

20. An inflatable container, comprising:

an outer container forming a first cavity;

an inner container forming a second cavity, the inner container being disposed within the outer container in such a way that a space between the inner and outer containers is created, the space comprising a support structure disposed within the space;

an inflatable support bench within the second cavity;

a top wall joining the inner and outer containers; and an inflation mechanism for introducing or removing a fluid or a gas into the space.

* * * * *